US008187059B2

(12) United States Patent
Bareel et al.

(10) Patent No.: US 8,187,059 B2
(45) Date of Patent: May 29, 2012

(54) DEVICE FOR POLISHING OPTICAL FIBERS MOUNTED IN A CONNECTOR

(75) Inventors: Baudouin Bareel, Auderghem (BE); Peter D'Hondt, Dendermonde (BE)

(73) Assignee: Nexans, Paris (FR)

( * ) Notice: Subject to any disclaimer, the term of this patent is extended or adjusted under 35 U.S.C. 154(b) by 462 days.

(21) Appl. No.: 12/368,370

(22) Filed: Feb. 10, 2009

(65) Prior Publication Data

US 2009/0221220 A1 Sep. 3, 2009

(30) Foreign Application Priority Data

Feb. 13, 2008 (EP) ..... 08305021

(51) Int. Cl.
*B24B 23/00* (2006.01)

(52) U.S. Cl. ..... 451/356; 451/357

(58) Field of Classification Search ..... 451/356, 451/357, 344, 386, 390, 391, 400, 384, 394
See application file for complete search history.

(56) References Cited

U.S. PATENT DOCUMENTS 426,716 A * 4/1890 Drake ..... 144/28.1
431,517 A * 7/1890 Harker ..... 144/28.1
547,151 A * 10/1895 Moseley ..... 144/28.9
4,291,502 A * 9/1981 Grimsby et al. ..... 451/271
5,199,224 A * 4/1993 Aluotto ..... 451/320
5,201,148 A 4/1993 Rupert et al.
5,577,149 A 11/1996 Averbeck et al.
5,727,989 A 3/1998 Ohno et al.
5,863,242 A 1/1999 Waldron et al.
6,951,508 B1 * 10/2005 Brubacher ..... 451/41

OTHER PUBLICATIONS

International Search Report dated May 19, 2008.

* cited by examiner

*Primary Examiner* — Robert Rose
(74) *Attorney, Agent, or Firm* — Sofer & Haroun, LLP

(57) ABSTRACT

The invention relates to a device for polishing the end of at least one optical fiber mounted in a connector, the device comprising a moving part supporting at least one connector and another moving part carrying a polishing film, the movement of these two parts being synchronized. According to the invention, these two parts are in direct contact via a movement transmission element, movement of one of them giving rise to movement of the other.

18 Claims, 3 Drawing Sheets

DEVICE FOR POLISHING OPTICAL FIBERS MOUNTED IN A CONNECTOR

RELATED APPLICATION

This application claims the benefit of priority from European Patent Application No. 08 305 021.1, filed on Feb. 13, 2008, the entirety of which is incorporated by reference.

FIELD OF THE INVENTION

The invention relates to a device for polishing optical fibers mounted in a connector.

BACKGROUND OF THE INVENTION

In general, an optical fiber connector includes a ferrule having the end of an optical fiber held therein. When a connection is made between two optical fibers in abutments, the ferrules of the connectors for each of the ends are coupled together so as to hold the optical fibers in alignment and in close contact, in order to minimize light losses. Light is lost whenever the ends of the fibers are not in alignment or are. separated by a gap.

It is therefore desirable to eliminate any misalignment or any gap of that type.

In order to ensure good contact between the end faces of the fibers, and thus ensure good light transmission, the ends are inserted and adhesively bonded in the ferrules of the connectors. Thereafter, the ends of the fibers are cut at a certain distance from the front faces of the ferrules and they are polished, with an initial step for shortening them using polishing paper of relatively coarse grain, and with one or more additional polishing steps using one or more polishing papers of finer grain. As a general rule, the paper used has grains of alumina or of diamond.

It is known to perform such polishing manually with the help of a ferrule support as described in patent document U.S. Pat. No. 5,201,148, or with the help of a support for connectors of different types as disclosed in patent document U.S. Pat. No. 5,863,242.

The support is then placed on a polishing paper and is moved by hand, generally to trace out a figure-of-eight shape, so as to ensure that polishing movements are performed in all directions and avoid forming polishing grooves that could lead to a poor polishing finish and to additional losses of light when the optical fibers are brought into abutment.

Nevertheless, such a manual polishing method requires personnel to be particularly highly qualified if a good result is to be obtained.

Document U.S. Pat. No. 6,951,508 proposes a mechanical polisher device that rotates a disk supporting a polishing film and that synchronously moves a ferrule support in translation by rotating a drive crank that may be turned manually or by a motor.

Nevertheless, that device is relatively bulky and of particularly complex structure, since synchronization is achieved by a system of gears inside the device.

OBJECT AND BRIEF SUMMARY OF THE INVENTION

The invention proposes an optical fiber polisher device that is of very lightweight structure, while still ensuring optimum polishing of the ends of such fibers, by simultaneously applying a movement in translation with a movement in rotation of the optical fiber mounted in a connector.

To do this, the invention provides a device for polishing the end of at least one optical fiber mounted in a connector, the device comprising a moving part supporting at least one connector and another moving part carrying a polishing film, the movement of these two parts being synchronized, wherein these two parts are in direct contact via a movement transmission element, movement of one of them giving rise to movement of the other.

By means of this synchronization by direct contact between the two moving parts, it is possible to make a device of small size, e.g. having a length of about 20 centimeters (cm) and a width of about 5 cm, or even less.

In a preferred embodiment, the connector support part is a disk that is free to rotate.

The disk carrying the polishing film is then preferably a slider that is movable in translation.

In a preferred variant, said movement transmission element is an anti-slip element.

Advantageously, said slider includes a longitudinal spline provided with said anti-slip element and guided to move in translation in a box.

Said anti-slip element may be constituted by a strip of rubber.

Preferably, said disk is rotatably carried by the box and is placed in contact with said spline.

Said disk may include a drive handle enabling it to be moved manually in rotation, thus making it possible when the slider comes into abutment at one end, to turn the disk without causing said slider to move in translation.

Because the actuator handle and thus the disk is turned manually and voluntarily, the position of the connector, and thus of the fiber relative to the slider and thus to the polishing film is modified, and consequently polishing does not always take place along the same path on the polishing film. The turning operation is thus performed regularly step by step so as to avoid wearing away the polishing film in the same position, thus making it possible to polish a much larger number of connectors with the same polishing film.

Said slider is advantageously separable from the box.

Such separation of the slider makes it possible to change the polishing film when it becomes worn. It also makes it possible to turn the slider over so as to use both faces of the slider, each of which is provided with a respective polishing film with differing grains. The second face is used during a second polishing step.

For this purpose, said slider may include on each of its main faces a face for receiving a respective polishing film.

BRIEF DESCRIPTION OF THE DRAWINGS

The invention is described below in greater detail with the help of figures that merely show a preferred embodiment of the invention.

MORE DETAILED DESCRIPTION

Figure 1:
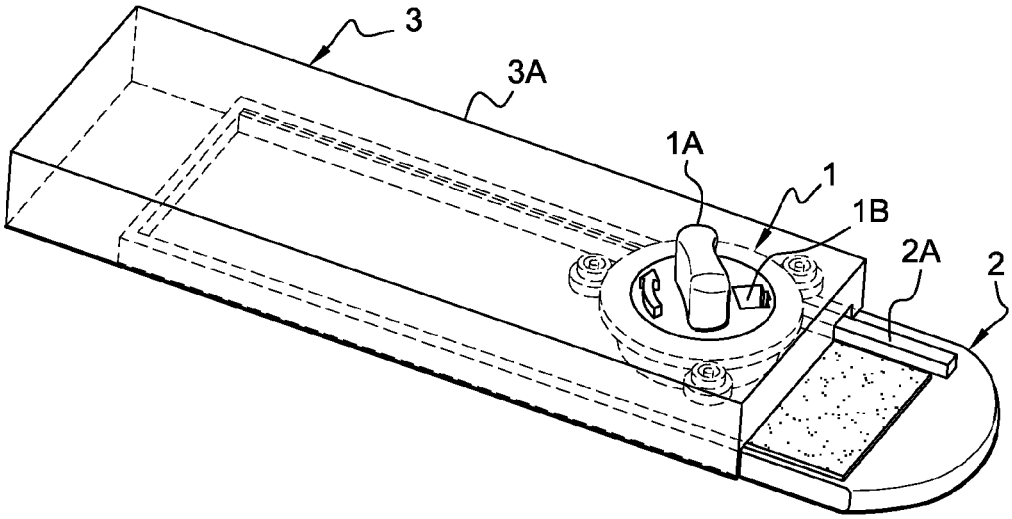
FIG. 1 is a perspective view of a device in accordance with the invention, seen from above.

FIG. 1 shows a device in accordance with the invention for polishing the end of an optical fiber carried by a connector, and it can be seen that it comprises a moving part 1 for supporting the connector and a moving part 2 carrying a polishing film, with the movement of these two parts being synchronized. As described in greater detail below, these two parts are in direct contact via an anti-slip element, with the movement of one thus entraining movement of the other.

Figure 2:
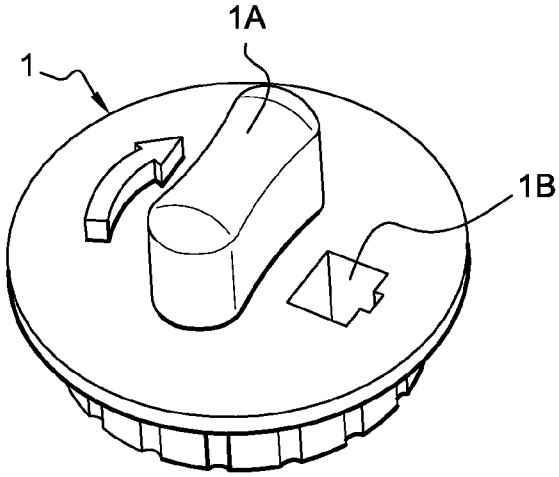
FIGS. 2, 3, and 4 are fragmentary perspective views of a device in accordance with the invention.

The connector support part 1 is a disk mounted to rotate freely and shown in detail in FIG. 2. The disk 1 has a handle 1A for manually driving it in rotation and a cavity 1B for receiving a connector.

Figure 3:
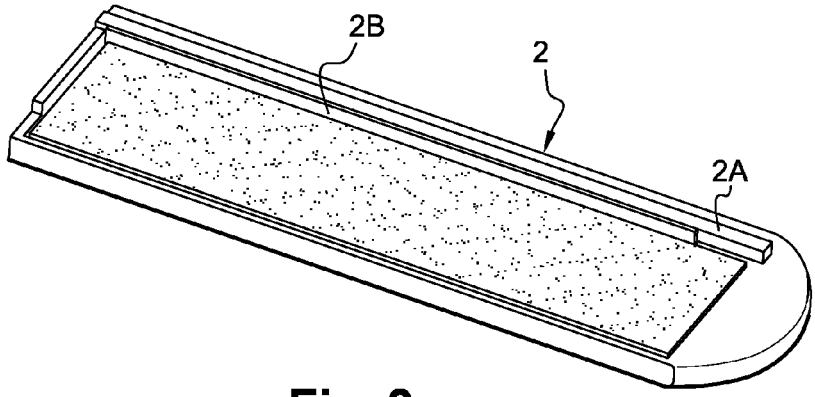

The part 2 carrying the polishing film is a slider that is movable in translation and that is also shown in detail in FIG. 3. The slider has a longitudinal side spline 2A provided with an anti-slip material that is preferably constituted by a strip of rubber 2B.

Figure 4A:
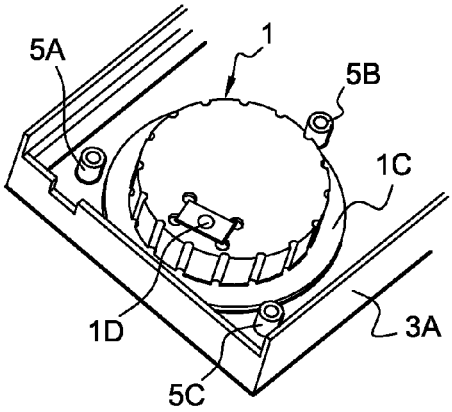
Figure 4B:
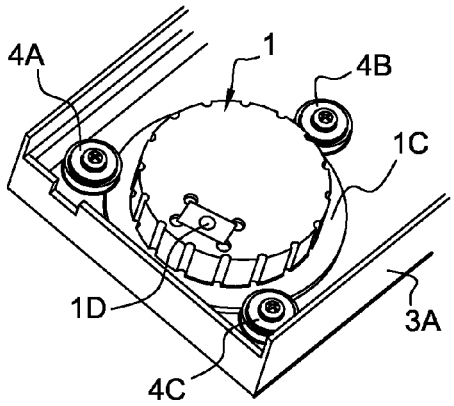

The slider 2 is guided to move in translation in a box 3 constituted by two half-boxes that are assembled together, and, as can be seen in FIGS. 4A and 4B, the disk 1 is mounted to rotate on the top half-box 3A and is placed in contact with the spline 2A.

The disk 1 has an annular flange 1C that is held free to rotate by three rings 4A, 4B, 4C that are screwed onto three studs 5A, 5B, 5C carried by the inside face of the top half-box 3A.

Figure 5:
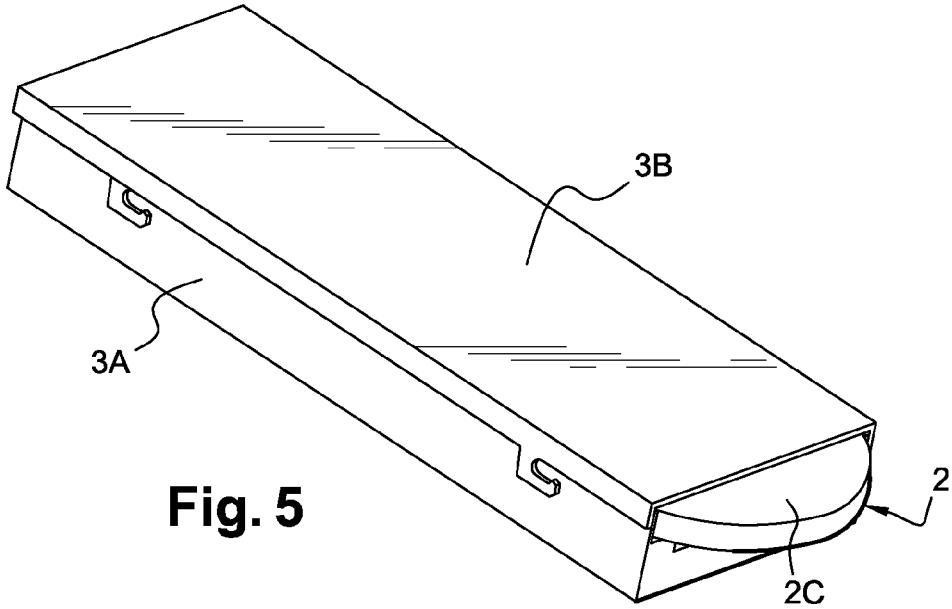
FIG. 5 is a perspective view of a device in accordance with the invention, seen from above.
Figure 6:
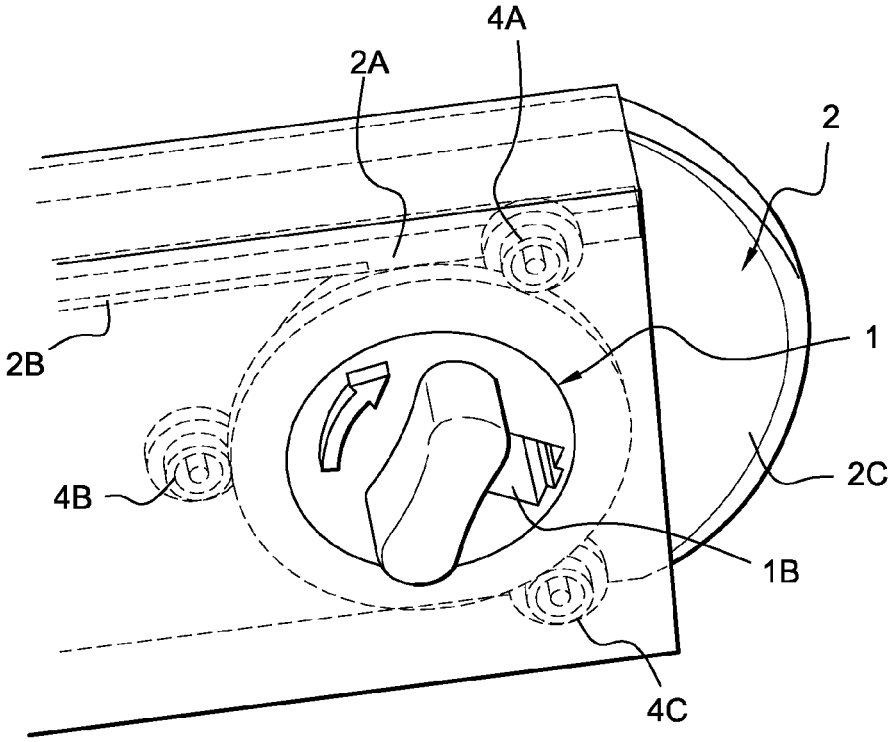
FIG. 6 is a fragmentary perspective view of a device in accordance with the invention.

The bottom half-box 3B is mounted on the top half-box 3A, as can be seen in FIG. 5, enclosing the slider 2 that is movable in translation and the disk 1 that is free to rotate in direct contact with the strip of rubber 2B carried by the side spline 2A of the slider, as shown in FIG. 6.

As can clearly be seen in FIGS. 5 and 6, the slider 2 has a handle extension 2C that projects from the box when the slider is fully inserted therein. The slider 2 is advantageously separable from the box 3 and may include on each of its main faces a face for receiving a polishing film and a spline provided with an anti-slip element.

The device of the invention for polishing the end of an optical fiber operates as follows.

An optical fiber is put into place in its connector and is cut at a certain distance from the end of the ferrule. The connector is placed in the reception cavity 1B in the disk 1. The end of the fiber that projects a little from the end of the ferrule of the connector then comes into contact with the polishing film carried by the slider 2, via the orifice ID visible in FIG. 4.

By manually gripping the handle extension 2C of the slider 2, it is possible to move the slider back and forth in translation within the box 3. During this movement, the disk 1 is driven in rotation by rolling on the rubber strip 2B of the slider 2. During these synchronized back-and-forth movements in translation and in rotation, the end of the optical fiber is thus polished with friction lines in all directions, thereby ensuring that polishing is optimized. The connector can subsequently be removed and used.

As specified above, the slider 2 is advantageously separable from the box 3 and it may include on each of its main faces a face for receiving a polishing film and a spline provided with an anti-slip element. Under such circumstances, two polishing operations are performed, the first using the film of larger grain size on one of the faces of the slider, and the second using the film of finer grain size on the other face of the slider, by extracting the slider and turning it over. The second polishing operation on a finer-grain film serves to obtain a better surface finish for the optical face and thus lower light loss when the fibers of two connectors are brought into abutment.

Furthermore, because the drive handle 1A and thus the disk 1 is turned manually and in voluntary manner, when the slider comes into abutment at one end, the relative position of the connector and thus of the fiber relative to the slider 2 and thus relative to the polishing film is modified, and consequently polishing does not always take place on the same path on the polishing film. This avoids always polishing the fiber at the same location on the polishing film, which would quickly make the film ineffective. This rotary operation using the drive handle 1A is thus performed regularly step by step.

A preferred embodiment of the invention is described above, however the invention covers other embodiments.

For example, on the principle of the invention, the slider 2 could be moved in translation under motor drive by installing a motor, the device then becoming automatic.

The disk 1 may have a single cavity 1B for receiving a connector as described above. It is also possible for it to have a plurality of such connector-receiving cavities. The cavities may then enable connectors to be received that are identical or that are of different types.

In the embodiment described, the element for transmitting movement is an anti-slip element 2B, preferably made of rubber, carried by the slider 2 and having the disk 1 rolling thereon. Still in the context of the invention, the movement transmission elements could be constituted, for example, by a rack arrangement, serving to transform the movement in translation of the slider 2 into rotation of the disk 1. A worm-screw is then placed to replace the spline 2A and the disk 1 includes corresponding teeth at its periphery.

What is claimed is:

1. A device for polishing the end of at least one optical fiber mounted in a connector, the device comprising:

a moving part supporting at least one connector and another moving part carrying a polishing film, the movement of these two parts being synchronized, wherein these two parts are in direct contact via a movement transmission element, movement of one of said moving parts giving rise to movement of the other and wherein the connector support part is a disk that is free to rotate.

2. The device according to claim 1, wherein the part carrying the polishing film is a slider that is movable in translation.

3. The device according to claim 1, wherein said movement transmission element is an anti-slip element.

4. The device according to claim 2, wherein said movement transmission element is an anti-slip element, and wherein said slider includes a longitudinal spline provided with said anti-slip element and guided to move in translation in a box.

5. The device according to claim 3, wherein said anti-slip element is constituted by a strip of rubber.

6. The device according to claim 4, wherein said disk is rotatably carried by the box and is placed in contact with said spline.

7. The device according to claim 6, wherein said disk includes a drive handle enabling it to be moved manually in rotation.

8. The device according to claim 4, wherein said slider is separable from the box.

9. The device according to claim 8, wherein said slider includes two main faces each of which has a face for receiving a respective polishing film.

10. A device for polishing the end of at least one optical fiber mounted in a connector, the device comprising:

a moving part supporting at least one connector and another moving part carrying a polishing film, the movement of these two parts being synchronized, wherein these two parts are in direct contact via a movement transmission element, movement of one of said moving parts giving rise to movement of the other and wherein the part carrying the polishing film is a slider that is movable in translation.

11. The device according to claim 10, wherein the connector support part is a disk that is free to rotate.

12. The device according to claim 10, wherein said movement transmission element is an anti-slip element.

13. The device according to claim 10, wherein said movement transmission element is an anti-slip element, and wherein said slider includes a longitudinal spline provided with said anti-slip element and guided to move in translation in a box.

14. The device according to claim 12, wherein said anti-slip element is constituted by a strip of rubber.

15. The device according to claim 13, wherein said disk is rotatably carried by the box and is placed in contact with said spline.

16. The device according to claim 15, wherein said disk includes a drive handle enabling it to he moved manually in rotation.

17. The device according to claim 14, wherein said slider is separable from the box.

18. The device according to claim 17, wherein said slider includes two main faces each of which has a face for receiving a respective polishing film.

* * * * *